US009587290B2

(12) United States Patent
Dunn et al.

(10) Patent No.: US 9,587,290 B2
(45) Date of Patent: Mar. 7, 2017

(54) HYDROMETALLURGICAL METHOD FOR THE REMOVAL OF RADIONUCLIDES FROM RADIOACTIVE COPPER CONCENTRATES

(71) Applicant: Orway Mineral Consultants (WA) Pty Ltd., East Perth, Western Australia (AU)

(72) Inventors: Grenvil Marquis Dunn, Springs (ZA); Stuart Saich, Santiago (CL); Peter John Bartsch, Mile End (AU)

(73) Assignee: Orway Mineral Consultants (WA) Pty, Ltd., East Perth (AU)

( * ) Notice: Subject to any disclaimer, the term of this patent is extended or adjusted under 35 U.S.C. 154(b) by 0 days.

(21) Appl. No.: 14/652,375

(22) PCT Filed: Mar. 14, 2014

(86) PCT No.: PCT/AU2014/000268
§ 371 (c)(1),
(2) Date: Jun. 15, 2015

(87) PCT Pub. No.: WO2014/138808
PCT Pub. Date: Sep. 18, 2014

(65) Prior Publication Data

US 2015/0329938 A1 Nov. 19, 2015

(30) Foreign Application Priority Data

Mar. 14, 2013 (AU) ..... 2013900893

(51) Int. Cl.
*C22B 3/00* (2006.01)
*C22B 15/00* (2006.01)
*C22B 3/04* (2006.01)

(52) U.S. Cl.
CPC ..... *C22B 15/0071* (2013.01); *C22B 3/045* (2013.01); *C22B 15/0008* (2013.01); *C22B 15/0069* (2013.01); *C22B 15/0086* (2013.01)

(58) Field of Classification Search
CPC ..... C22B 15/0071; C22B 15/0008; C22B 15/0069; C22B 15/0086; C22B 3/045; C22B 60/0226; C22B 60/023; C22B 60/0234; C22B 30/06; C22B 13/04
USPC ..... 423/87, 98, 41, 38, 39, 27, 2–4, 18, 20
See application file for complete search history.

(56) References Cited

U.S. PATENT DOCUMENTS

| | | | | |
|---|---|---|---|---|
| 2,568,963 | A | 9/1951 | McGauley et al. | |
| 2,662,009 | A | 12/1953 | Roberts | |
| 2,744,172 | A | 5/1956 | Porter et al. | |
| 3,798,026 | A | 3/1974 | Milner et al. | |
| 4,024,218 | A | 5/1977 | McKay et al. | |
| 4,594,132 | A | 6/1986 | Satchell, Jr. et al. | |
| 5,354,358 | A * | 10/1994 | Litz | C01G 43/01 423/2 |
| 5,356,457 | A | 10/1994 | Pincheira Alvarez et al. | |
| 5,527,382 | A | 6/1996 | Pincheira Alvarez et al. | |
| 5,730,776 | A | 3/1998 | Collins et al. | |
| 5,869,012 | A | 2/1999 | Jones | |
| 5,874,055 | A | 2/1999 | Jones | |
| 5,902,474 | A | 5/1999 | Jones | |
| 5,917,116 | A | 6/1999 | Johnson et al. | |
| 6,159,435 | A | 12/2000 | Nguyen | |
| 6,503,293 | B1 | 1/2003 | Dempsey et al. | |
| 6,676,909 | B2 | 1/2004 | Marsden et al. | |
| 6,755,891 | B2 | 6/2004 | Jones | |
| 6,929,677 | B2 | 8/2005 | Hamalainen | |
| 7,341,700 | B2 | 3/2008 | Marsden et al. | |
| 7,473,413 | B2 | 1/2009 | Marsden et al. | |
| 7,485,216 | B2 | 2/2009 | Marsden et al. | |
| 7,491,372 | B2 | 2/2009 | Faine et al. | |
| 7,736,488 | B2 | 6/2010 | Marsden et al. | |
| 7,846,233 | B2 | 12/2010 | Dixon et al. | |
| 2001/0001650 | A1 | 5/2001 | Duyvesteyn et al. | |
| 2002/0044899 | A1 | 4/2002 | Marsden et al. | |
| 2003/0170158 | A1 | 9/2003 | Hard et al. | |
| 2004/0060395 | A1 | 4/2004 | Hamalainen | |

(Continued)

FOREIGN PATENT DOCUMENTS

| | | |
|---|---|---|
| AU | 536607 | 5/1984 |
| AU | 642844 | 1/1993 |

(Continued)

OTHER PUBLICATIONS

Burkin A.R., Chemical Hydrometallurgy, 1952-1994, Trans. Inst Min. Metall., 103, 1994, C169-C176.
Dreisinger, "Copper leaching from primary sulfides: Options for biological and chemical extraction of copper", Hydrometallurgy, vol. 83, pp. 10-20, 2006.
International Search Report issued in International Application No. PCT/AU2014/000268, Apr. 15, 2014, 3 pages.

(Continued)

*Primary Examiner* — Steven Bos
(74) *Attorney, Agent, or Firm* — Hamre, Schumann, Mueller & Larson, P.C.

(57) ABSTRACT

A hydro-metallurgical method 80 for the removal of uranium, thorium, radium, lead, bismuth and polonium and/or other radionuclides from a radioactive copper concentrate to produce an upgraded copper concentrate having lowered emission levels. The method comprises the step of: subjecting the copper concentrate to an acidic leaching process (NONOX leach) 120 using a sulfate and chloride containing lixiviant under electrochemically controlled conditions, to allow at least partial removal of one or more of the radionuclides to produce the lowered emission upgraded copper concentrate, wherein the leaching process is conducted at elevated temperature and under pressure to suppress boiling in the leaching process.

23 Claims, 1 Drawing Sheet

(56) References Cited

U.S. PATENT DOCUMENTS

| | | | |
|---|---|---|---|
| 2005/0269208 | A1 | 12/2005 | Dixon et al. |
| 2008/0216606 | A1 | 9/2008 | Marsden et al. |
| 2010/0313713 | A1 | 12/2010 | Kuwazawa et al. |

FOREIGN PATENT DOCUMENTS

| | | |
|---|---|---|
| AU | 658705 | 6/1993 |
| AU | 199881876 | 3/1999 |
| AU | 199911262 | 5/1999 |
| AU | 200035154 | 9/2000 |
| AU | 200071731 | 5/2001 |
| AU | 2001277161 | 2/2002 |
| AU | 2002333937 | 5/2003 |
| AU | 2004243345 | 12/2004 |
| AU | 2004202870 | 2/2005 |
| AU | 2004285993 | 5/2005 |
| AU | 2005250064 | 12/2005 |
| AU | 2004324610 | 5/2006 |
| AU | 2006212146 | 8/2006 |
| AU | 2007100118 | 3/2007 |
| AU | 2007248092 | 11/2007 |
| AU | 2008200206 | 8/2008 |
| AU | 2012/000090 | 1/2012 |
| CA | 1 258 181 | 8/1989 |
| EP | 0 214 324 | 3/1987 |
| RU | 2 273 298 | 7/2008 |
| WO | 98/19779 | 5/1998 |
| WO | 02/08475 | 1/2002 |
| WO | 2004/016561 | 12/2004 |
| WO | 2004/106561 | 12/2004 |
| WO | 2006/049632 | 5/2006 |
| WO | 2007/130985 | 11/2007 |
| WO | 2011/116426 | 9/2011 |
| WO | 2014-138809 | * 9/2014 |
| ZA | 1998/01215 | 10/1998 |

OTHER PUBLICATIONS

International Preliminary Report on Patentability, issued in International Application No. PCT/AU2014/000268, Nov. 3, 2014, 4 pages.

* cited by examiner

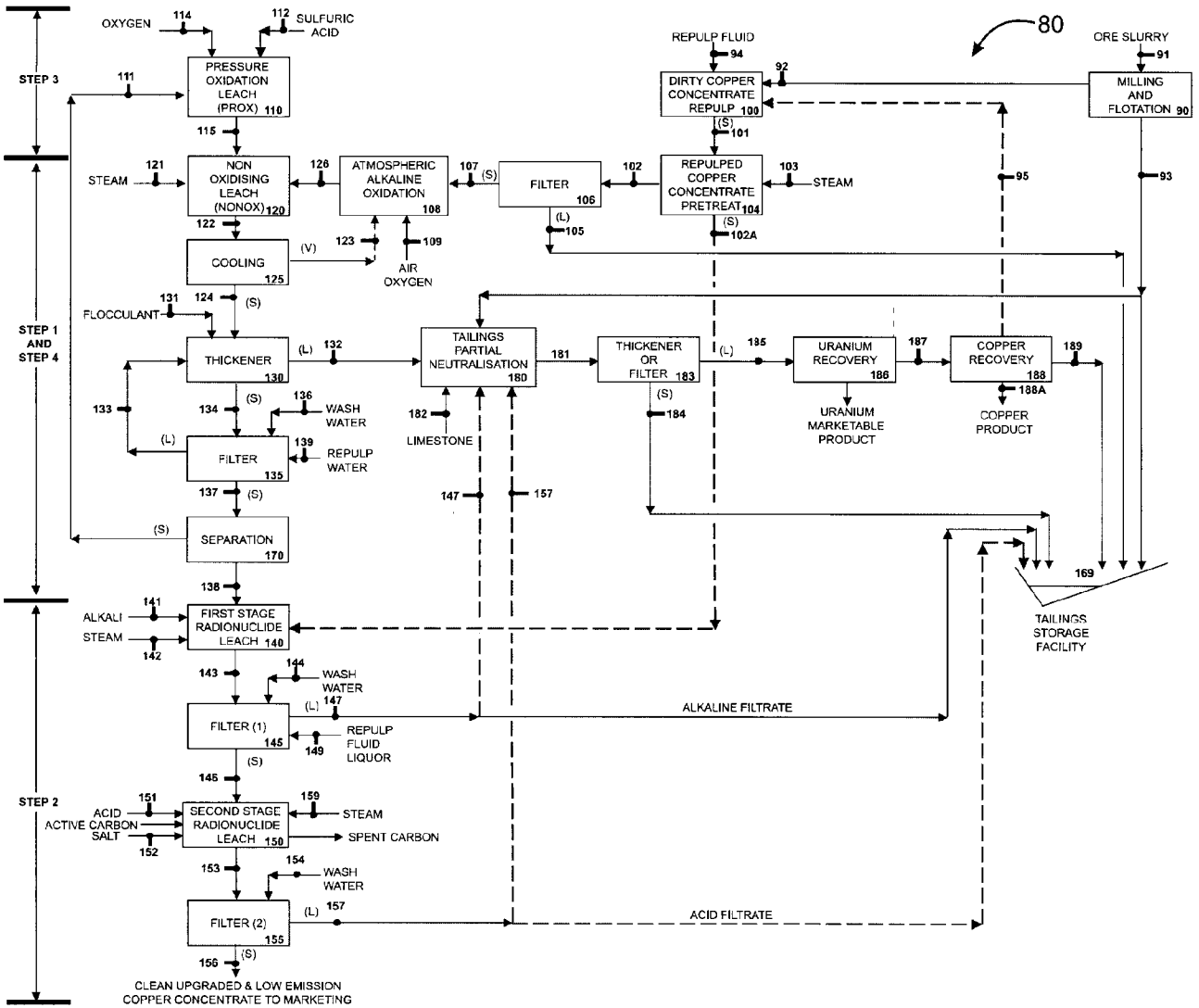
80
ORE SLURRY
91
MILLING AND FLOTATION 90
93
95
169
TAILINGS STORAGE FACILITY
COPPER RECOVERY 188
188A
COPPER PRODUCT
189
187
URANIUM RECOVERY 186
URANIUM MARKETABLE PRODUCT
185
THICKENER OR FILTER 183
184
181
TAILINGS PARTIAL NEUTRALISATION 180
182
LIMESTONE
157
147
ALKALINE FILTRATE
ACID FILTRATE
REPULP FLUID
94
92
DIRTY COPPER CONCENTRATE REPULP 100
101
REPULPED COPPER CONCENTRATE PRETREAT 104
102A
103
STEAM
102
FILTER 106
105
107
ATMOSPHERIC ALKALINE OXIDATION 108
109
AIR OXYGEN
123
126
SULFURIC ACID
112
PRESSURE OXIDATION LEACH (PROX) 110
114
OXYGEN
111
115
NON OXIDISING LEACH (NONOX) 120
121
STEAM
122
COOLING 125
124
131
FLOCCULANT
THICKENER 130
132
133
134
WASH WATER
136
REPULP WATER
139
FILTER 135
137
SEPARATION 170
138
FIRST STAGE RADIONUCLIDE LEACH 140
141
ALKALI
142
STEAM
143
WASH WATER
144
FILTER (1) 145
146
REPULP FLUID LIQUOR
149
SECOND STAGE RADIONUCLIDE LEACH 150
151
ACID
ACTIVE CARBON
152
SALT
153
STEAM
159
SPENT CARBON
WASH WATER
154
FILTER (2) 155
156
CLEAN UPGRADED & LOW EMISSION COPPER CONCENTRATE TO MARKETING
STEP 3
STEP 1 AND STEP 4
STEP 2

HYDROMETALLURGICAL METHOD FOR THE REMOVAL OF RADIONUCLIDES FROM RADIOACTIVE COPPER CONCENTRATES

FIELD OF THE INVENTION

The present invention relates to a method for the hydrometallurgical removal of radionuclides from radioactive copper concentrates. The method relates particularly although not exclusively to the removal of the radionuclides uranium, thorium, radium, lead, bismuth and polonium. The method relates typically but not exclusively to the removal of radionuclides from copper concentrates being primary copper sulphide flotation concentrates and matte.

BACKGROUND TO THE INVENTION

The dominant copper-containing minerals in most copper sulfide deposits are chalcopyrite, cubanite and bornite. Chalcocite, covelite and in some cases enargite or tennantite are also present. The gangue mineral sulfides sometimes have pyrite and pyrrhotite present, many of these along with lesser quantities of host or gangue minerals report to the final flotation concentrate.

High-grade, copper sulfide concentrates, (typically greater than about 25% Cu weight/weight), are commonly treated by pyrometallurgical routes, whereas hydrometallurgical routes are generally favoured for the lower-grade, or impurity bearing copper concentrates. The economically and technically most favourable processing route can also be influenced by the concentration of minor amounts of valuable metals such as cobalt and nickel, or payable precious metals such as silver, gold, palladium and platinum, as well as contamination by radioactive elements such as uranium, thorium, radium, lead, bismuth or polonium and deleterious metals such as arsenic, present in the feed material. Hydrometallurgical processing routes are generally more energy consuming than smelting, because the heat of combustion of the concentrates is not efficiently utilized.

The three dominant pyrometallurgical routes for high-grade, copper sulfide concentrates are;

a) smelting to a matte followed by converting to blister copper,
b) direct to blister smelting and
c) oxidative roasting.

The efficiency of the smelting technology is determined by, amongst other things, the Cu/S ratio and the concentration of slag forming components, especially iron, magnesium and silica. Conventional smelting processes are generally not applicable to lower grade copper concentrates. Not all of the copper content of the original feed is recovered as blister copper, with the remaining copper reporting to the slag and to the smelter dusts or fumes recovered from the smelter off-gases.

Roasting of copper concentrates requires the conversion of the copper content to a water-soluble or sulfate form, which is recovered from the roaster calcine by leaching, followed by solvent extraction and electrowinning. Roasting is often inefficient because copper-containing insoluble ferrite phases can form during the roasting stage and lock some copper and valuable by-products such as cobalt.

Many hydrometallurgical processes have been described for treating copper-containing concentrates, for example;

Burkin A. R, Chemical Hydrometallurgy, 1952-1994, Trans. Inst Min. Metall., 103, 1994, C169-C176.

Dreisinger, D, Copper leaching from primary sulfides: Options for biological and chemical extraction of copper, HYDROMETALLURGY, 2006, 83, 10-20.

Few of the proposed processes have attained full-scale commercial development, and most give little or no attention to removal of impurity or penalty elements, including radionuclides, or disposal of these elements by environmentally benign methods. Hydrometallurgical processes for copper concentrates struggle to compete economically against pyrometallurgical steps such as smelting, for reasons including:

a) effective removal of impurity or penalty elements,
b) cost of power,
c) environmentally acceptable disposal of residues, and
d) difficulty in precious metal recovery.

Economic performance of the smelting routes in particular is improved if copper concentrates can be upgraded in their copper content or deleterious impurities can be removed before being fed to the smelting furnaces. But the source or production of copper sulfate solution for 'metathesis' reactions, and deportment of the impurity, radioactive or value elements, is not considered in most treatment routes, and nor is the disposal of residues and effluents.

Various means of hydrometallurgical upgrading of the copper content of a copper concentrate have been proposed, including 'metathesis' leaching which displaces the iron content of the concentrate with an equivalent stoichiometric amount of copper. The so-called 'metathesis' process, in which the chalcopyrite component of the concentrate is reacted with a copper sulfate solution to produce low-iron copper sulfide (e.g. digenite) and an acidic, ferrous sulfate solution, can be represented.

$$3CuFeS_2+6CuSO_4+4H_2O \rightarrow 5Cu_{1.8}S+3FeSO_4+4H_2SO_4 \quad (1)$$

A similar reaction also occurs for any bornite present in the copper concentrate.

$$3Cu_5FeS_4+6CuSO_4+4H_2O \rightarrow 5Cu_{1.8}S+6Cu_2S+3FeSO_4+4H_2SO_4 \quad (2)$$

Similar reactions occur when cobalt is recovered from a blend of cobaltite and chalcopyrite minerals or carrollte.

The descriptions of processes which involve metathesis reactions do not generally include the source of copper sulfate, the deportment of impurity, valuable and radioactive elements, or the treatment and disposal of residues and effluents.

One or both of these above reactions (1) and (2) are referred to directly or indirectly in U.S. Pat. Nos. 2,568,963, 2,662,009, 2,744,172 and 4,024,218, Canadian Patent No. 1 258 181, South African Patent No. 2007/01337, and WIPO Patent Publication No. WO 2004/106561. All of these patents propose to forward the upgraded copper sulfide concentrate, which typically contains above 50% Cu, to either a smelter or treatment by other means.

The flowsheets in these patent specifications contain several deficiencies, such as identifying an economic source of copper sulfate solution, incomplete separation of iron and copper in solution, the requirement of additional flotation steps, economic recovery of precious metals from the residues, or have difficulty removing other impurities such as radionuclides, including uranium and its decay elements, and the final destination or treatment route of residues and effluents which can be problematic.

The present invention aims to at least partially overcome some of these deficiencies, and also addresses more importantly the removal of uranium, along with the other radionuclides which are its decay elements, that would otherwise limit or penalise the processing of the concentrate in an off-shore or remote smelter, or prohibit or restrict the international trade of copper concentrate across international borders. Thus the present invention aims to reduce the level of uranium and other radionuclides in a radioactive or 'dirty' copper concentrate to allow the concentrate to be smelted within the limits of national or international regulations.

Furthermore, the present invention attempts to assist in minimising the overall capital and operating cost components of the total processing of concentrates, as well as allowing disposal of treatment residues by means acceptable to regulatory authorities.

References to prior art in this specification are provided for illustrative purposes only and are not to be taken as an admission that such prior art is part of the common general knowledge in Australia or elsewhere.

SUMMARY OF THE INVENTION

According to one aspect of the present invention there is provided a hydrometallurgical method for the removal of uranium, thorium, radium, lead, bismuth and polonium and/or other radionuclides from a radioactive copper concentrate to produce an upgraded copper concentrate having lowered emission levels, the method comprising the step of:

subjecting the copper concentrate to an acidic leaching process (NONOX leach) using a sulfate and chloride containing lixiviant under electrochemically controlled conditions, to allow at least partial removal of one or more of the radionuclides to produce the lowered emission upgraded copper concentrate, wherein the leaching process is conducted at elevated temperature and under pressure to suppress boiling in the leaching process.

Preferably the leaching process (NONOX leach) is conducted at an electrochemical potential of greater than 200 mV (Ag/AgCl 3.8M KCl). More preferably the leaching process (NONOX leach) is conducted at an electrochemical potential in the range of between about 200 mV and 450 mV (Ag/AgCl 3.8M KCl).

Typically the electrochemical potential of the NONOX leach is controlled by the presence of, or the addition to the NONOX leach of, one or more of copper sulfate, ferric ion, air, oxygen, sodium chlorate, pyrolusite, or hematite.

Preferably the sulfate and chloride containing lixiviant comprises copper sulfate and sodium chloride.

Preferably the radionuclides comprise one or more radionuclides selected from the group comprising U238, Th230, Ra226, Pb210, Po210 and Bi210.

Preferably the NONOX leach allows for the removal of about 50% to 99% of the uranium and thorium, and allows for lowering of radium, lead, bismuth and polonium levels to below 3 Bq/g.

The sulfate and chloride containing lixiviant typically comprises one or more of the following solutes: sulfuric acid, hydrochloric acid, sodium chloride, chloride salt, potassium chloride, and copper sulfate, the sulfate and chloride containing lixiviant being obtained from within the NONOX leach, or from a source external to the NONOX leach. The sulfate and chloride containing lixiviant may comprise one or more of seawater, brines from seawater desalination, and fluorides, or other anions leached from the radioactive copper concentrate, or from process water.

Preferably the NONOX leach is conducted between about 100 degrees C. and 240 degrees C. More preferably the NONOX leach is conducted between about 160 degrees C. and 240 degrees C.

In the hydrometallurgical method of the invention, copper-iron-sulfides and cupric sulfide (covellite) are typically transformed in the NONOX leach, and more usually the NONOX leach is conducted under conditions to transform 50% to 99% of the copper-iron-sulfides to iron-depleted copper sulfides and covellite to a sulfur-depleted variant (digenite/chalcocite).

Preferably each radionuclide in the lowered emission upgraded copper concentrate has a radioactive emission level of about 0.1 to 1.5 Bq/g. The lowered emission upgraded copper concentrate may typically have a radioactive emission level of less than about 0.5 Bq/g for each of U238 and Th230, and a radioactive emission level of less than about 3 Bq/g for each of the other radionuclides.

Preferably the NONOX leach is conducted at a pressure in the range of 500-3500 kPa.

Typically retention time of the NONOX leach is between about 0.5 and 8 hours.

The method may further comprise the step of feeding into the NONOX leach a copper sulfate slurry from a pressure oxidation reactor (PROX reactor), or copper sulfate solution from an external source. The sulfate slurry typically comprises copper sulfate, iron sulfate and sulfuric acid.

The method may further comprise an alkali and/or an acid pre-treatment step to reduce the radionuclide activity of the radioactive copper concentrate prior to the NONOX leach. Typically the pre-treatment step comprises repulping of the copper concentrate with copper-rich process liquors to form a repulped concentrate, treating the repulped concentrate with steam to raise the temperature, and removing copper from the repulped concentrate in a metathesis process.

The method may further comprise a post-treatment step to further remove radionuclides from the lowered emission upgraded copper concentrate. The post-treatment step typically comprises cooling of the lowered emission upgraded copper concentrate to produce a cooled slurry, thickening of the cooled slurry, and filtering of the thickened cooled slurry to produce a further upgraded copper concentrate.

Preferably the post-treatment step comprises as least an acid treatment to remove further radionuclides such as Ra226, Pb210, Po210 and Bi210.

Throughout the specification, unless the context requires otherwise, the word "comprise" or variations such as "comprises" or "comprising", will be understood to imply the inclusion of a stated integer or group of integers but not the exclusion of any other integer or group of integers. Likewise the word "preferably" or variations such as "preferred", will be understood to imply that a stated integer or group of integers is desirable but not essential to the working of the invention.

BRIEF DESCRIPTION OF THE DRAWINGS

The nature of the invention will be better understood from the following detailed description of preferred embodiments of the invention, given by way of example only, with reference to the accompanying drawing, in which:

FIG. 1 is a flow diagram of an embodiment of the hydrometallurgical method of the invention for the removal of radionuclides from a radioactive or 'dirty' copper concentrate.

DETAILED DESCRIPTION OF PREFERRED EMBODIMENTS

The following description is a preferred embodiment of the hydrometallurgical method 80 of the present invention and refers to the process flowsheet in FIG. 1.

Copper concentrate [92] is produced by known methods of treating sulfide ore [91] such as milling and flotation [90]. Tailings [93] which contain the gangue minerals may be disposed directly to impoundment [169] or utilized for neutralization of effluent streams, or treatment of discharge liquors [180].

The "dirty" or radioactive copper flotation concentrate [92] containing primary and secondary copper sulfides, iron sulfides, primary uranium minerals and associated radionuclides is repulped [100] with process liquors that may contain copper, iron, sulfates, chlorides [94]. Typically the copper sulfide minerals include one or more of: chalcopyrite, covelite, bornite, chalcocite, cubanite, enargite, tennantite, tetrahedrite. Typically the iron sulfides may contain pyrite, arsenopyrite, pyrrhotite and the like. Typically the primary uranium minerals may contain brannerite, betafite, davidite, coffinite and uraninite. Generally, the decay products of uranium will be associated with the uranium minerals, but may be distributed with other minerals depending on the prior treatment of the ore and concentrate.

Repulped concentrate slurry [101] is advanced to a pretreatment circuit [104] where steam [103] is employed to raise the slurry temperature to near atmospheric boil point. The concentrate in [104] can be employed to recover copper in a metathesis process from the repulp fluid [94] and then filtered [106] to reject unwanted soluble iron, etc. [105] to a tailings facility [169].

Optionally the pre-treated concentrate [107] can be slurried in process liquors and treated in an alkaline oxidation step [108], employing steam [123] and air or oxygen [109] and the hot slurry [126] is then pumped into the NONOX reactor for an acid leaching process (NONOX leach) [120].

An alternate variant to the upgrade of the dirty or radioactive copper concentrate has the dirty or radioactive copper concentrate [92] being fed to the first-stage radionuclide leach [140]. A further variant has the dirty copper concentrate [92] being fed direct to the NONOX reactor [120] (not shown in FIG. 1).

The radioactive ('dirty') copper concentrate is subjected to an acidic leaching process (NONOX leach) using a sulfate and chloride lixiviant under electrochemically controlled conditions, to allow at least partial removal of one or more of the radionuclides to produce the lowered emission upgraded copper concentrate, wherein the leaching process is conducted at elevated temperature and under pressure to suppress boiling in the leaching process.

The NONOX reactor [120] receives a copper sulfate, iron sulfate and sulfuric acid containing slurry [115] from the pressure oxidation (PROX) reactor [110]. Optionally stream [115] can be a copper, iron sulfate stream from which the pressure oxidation leach residue has been separated. Another option generates stream [115] within the NONOX reactor from the products of the NONOX reaction from the dirty concentrates [92] or the pre-treated concentrates [102] or [126].

Preferably this hot slurry [115] from the PROX reactor [110] is fed directly without cooling into the NONOX reactor [120]. Steam [121] may be supplemented to maintain the reactor at the target temperature.

Temperatures below 240° C. and typically below 210° C. are employed in the NONOX leach. Typically the NONOX leach is conducted between about 100° C. and 240° C., and more typically between about 160° C. and 240° C. Nominally anaerobic leach conditions are maintained through the NONOX reactor. Small quantities of oxygen, air or an appropriate oxidant may be required to influence the overall chemistry within the reactor or to control the electrochemical potential of the reactor above typically 200 mV (Ag/AgCl; 3.8M KCl), and more typically in the range of between about 200 mV and 450 mV (Ag/AgCl 3.8M KCl).

Conditions are employed such that a majority of the iron associated with the copper minerals is removed and a near stoichiometric amount of copper is precipitated in the concentrate.

Advantageously, conditions are employed in the reactor such that there is above 90% removal of uranium and thorium, and above 30% removal of radium, lead and polonium from the concentrate. Other base metals such as nickel, cobalt and zinc are also substantially removed from the dirty copper concentrate.

Copper solution transferred in stream [115] is lowered to concentration between 5-50 g/L in the exit stream [122] from the NONOX leach reactor.

The other components of the aqueous fraction of NONOX discharge [122] will vary with the mineral assemblage in concentrate, the carrier fluid comprising the slurry and the soluble content of feed stream [126] but include iron (major), sulfuric acid (major) and lesser quantities of dissolved uranium, lead, thorium, radium, polonium, bismuth, aluminium, selenium, magnesium, calcium, silicon, and other soluble metal anions such as sulfates, chlorides, etc.

A NONOX leach retention time of between 0.5 and 8 hours is required and typically this could be between 1 to 3 hours.

Stream [122] is preferably cooled in a flash tank [125] where steam [123] and slurry [124] are discharged.

The flash steam [123] can be scrubbed and then used for preheat duties. Excess flash steam can be released to atmosphere or employed elsewhere in the flowsheet for heating.

The cooled slurry [124] can be further cooled and then thickened in decanter [130]. Flocculant [131] and recycle filtrate [133] and internal solution recycles are employed to aid slurry thickening. The thickener overflow [132] can be further clarified before optionally recovering uranium [186] and thereafter copper recovery [188].

Alternately, the thickener overflow liquor [132] is partially neutralised [180] by employing for example, alkaline filtrate [147], flotation tailings [93] and or limestone [182]. The partial neutralisation step is employed to remove the acid from thickener overflow [132] and filtrate [157]. Additionally any radium, lead, bismuth and polonium in streams [132] and [157] are precipitated.

The partial neutralisation slurry [181] can be thickened and or filtered [183] to produce a slurry or cake [184].

The partial neutralisation filtrate [185] can be further processed in [186] for the recovery of uranium and the recovery of copper [188] which can be recycled [95] to repulp or concentrate [100], or marketed with clean concentrate [188A]. The waste liquor containing primarily iron and lesser quantities of aluminium, magnesium, potassium, calcium, etc. [189] can be disposed of in the tailings storage facility [169].

The thickened slurry [134] is filtered [135] and the upgraded copper concentrate is then washed with water [136] before it is repulped in clean water [139] and transferred as a washed upgraded copper concentrate [137].

The washed concentrate is split [170] into two portions by employing known processes e.g. flotation, cycloning, screening, partitioning, etc. One part [111] is employed in the PROX leach [110], and the balance [138] is fed forward to an optional first-stage radionuclide leach [140].

The upgraded copper concentrate [111] that is fed to the PROX leach [110] may have an iron analysis of 3 to 5%, and in the PROX process this will be oxidised to a mixture of ferrous and ferric sulfates.

The PROX reactor [110] receives the upgraded copper concentrate slurry [111] along with sulfuric acid [112] and oxygen or air [114].

The PROX reactor operates:

at temperatures below 240° C. and typically between 140 and 180° C.;

at an oxygen partial pressure of between 200 and 1000 kPa, and with a retention time of between 0.25 and 6 hours.

Sulfuric acid is required to stabilise copper (and iron) in solution. A free acid concentration of between 1 and 50 g/L is adequate for the (PROX) reactor [110].

Alternately the PROX reactor discharge [115] can be flashed as in the case of the NONOX reactor discharge [122] and the flashed underflow further separated into a solids fraction and a liquid fraction. The liquid fraction can then be fed to the NONOX reactor [120] and the solid fraction combined with stream [138] after the separation [170].

The PROX reactor discharge [115] can be flashed as in the case of the NONOX reactor discharge [122], and a flash tank underflow slurry pumped into the NONOX reactor [120]. Preferably, the PROX reactor [110] discharges directly into the feed of the NONOX reactor [120].

The latter option is more thermally efficient and will require less supplementary steam [121] to sustain the NONOX reactor [120] at its design operating temperature.

The repulped upgraded copper concentrate stream [138] is the feed to the optional first-stage radionuclide leach [140].

In the event that the PROX-NONOX steps (1) (3) (4) are not required to leach the uranium or radionuclides in the "dirty" copper concentrate [101], then a preheated repulped copper concentrate stream [102] can alternately be employed as the feed [102A] to the first-stage radionuclide leach [140].

The first and second-stages of radionuclide leaching [140] and [150] are only required if the radioactivity levels are "export limiting" in regard to marketing or regulation of upgraded copper concentrate.

A sodium-based alkaline reagent, preferably sodium carbonate or sodium hydroxide [141], may be employed to remove sulfate chemical species from the NONOX upgraded copper concentrate [138]. The first-stage leach liquor may also contain chlorides, should saline process waters be available.

The first-stage radionuclide leach [140] is conducted at temperatures below 100° C. Typically temperatures in the region of 40 to 95° C. are adequate. Steam [142] is employed to provide the energy required to maintain the required temperatures in the leach [140].

A retention time of between 0.1 and 6 hours is required in the first-stage radionuclide leach [140].

The first-stage radionuclide leach [140] is conducted in a mildly oxidising electrochemical potential of the reactor above typically 250 mV, (Ag/AgCl; 3.8M KCl), to facilitate the dissolution of the electropositive radionuclides from the residue [138].

The first-stage radionuclide leach discharge [143] is filtered in a filter [145]. The residue is washed with water [144] to remove a majority of the soluble sulfate in the leach residue and the combined filtrate and wash filtrate [147] can be disposed of to the Tailings Partial Neutralisation Step [180] or the Tailings Storage Facility [169].

The first-stage leached concentrate [143] following the filter [145] is repulped in a repulp fluid [149] to produce a slurry [146] that is fed to the second-stage radionuclide leach [150].

The repulp fluid [149] can be a recycled acidic filtrate [157] or water.

The second-stage radionuclide leach [150] requires an acid [151] and optionally a chloride salt [152] to sequester and dissolve the radionuclide species and hence lixiviate them from the upgraded copper concentrate. Preferably the acid is hydrochloric acid [151] and optionally the salt is sodium chloride [152]. Mixtures of acids and salts or anions of the type nitrate, citrate, acetate etc. that enhance the dissolution of some of the radionuclides e.g. radium, lead, bismuth, polonium, etc. can also be employed in the second-stage radionuclide leach [150].

The second-stage radionuclide leach [150] is conducted at temperatures below 100° C. Typically temperatures in the region of 30 to 95° C. are adequate. Steam [159] or heated repulp fluid [149] employed to sustain the required temperatures in the leach [150].

A retention time of between 0.1 to 6 hours is required in the second-stage radionuclide leach [150].

The second stage leach can be conducted as a filter-wash step. The acid stream [151] with or without the salt stream [152] can be applied to the washed first-stage residue in filter [145].

The second-stage radionuclide leach [150] is conducted under anaerobic to mildly aerobic conditions of the reactor above typically 250 mV, (Ag/AgCl; 3.8M KCl) to facilitate dissolution of the electro-positive radionuclides.

The second-stage radionuclide leach discharge slurry [153] is filtered in a filter [155]. The residue in the filter is washed with desalinated water [154] to remove a majority of the chloride in the concentrate. The liquor filtrate and the wash filtrate [157] is transferred to the Tailings Partial Neutralisation step [180] or to the Tailings Storage Facility [169].

The washed residue [156] from the filter [155] is the 'clean', or upgrade, low emission, copper concentrate which is destined for the market without restrictions.

Alternately, the processes of Step (2), including first and second stage radioactive leaching, may be conducted prior to NONOX leach step (4). The sequence of the leach steps will be optimally determined following experimental tests on samples of the 'dirty' concentrate, and will depend on its distribution and content of the radioactive elements and their various responses.

Example 1

A dirty or radioactive copper concentrate containing 29% Copper, 27.2% Iron, 27.6% total Sulfur, 27.5% Sulfide, Sulfur consisting predominantly of chalcopyrite, some bornite, some pyrite was tested, employing part of the flowsheet in FIG. 1. The uranium concentration was approximately 1050 PPM. The precious metals concentration was not determined.

This concentrate was subjected to a non-oxidising (NONOX) leach at 20% solids where lixiviant concentration was 77 g/L Copper as copper (2) sulfate, 4.7 g/L Ferric as iron (3) sulfate and 4.8 g/L total soluble Iron, and containing additional dissolved chloride comprising sodium chloride and hydrochloric acid. The NONOX leach temperature was 185° C. and the total pressure was approximately 1100 kPa(g).

After a leach period of 2 hours the upgraded copper concentrate assayed:

| | % |
|---|---|
| Cu | 56.8 |
| Fe | 7.2 |
| S(Sulfide) | 27.6 |
| U | 28.7 (PPM) |

Example 2

In a test to demonstrate the pressure oxidative (PROX) leach an upgraded copper concentrate with the assay below was employed in the batch leach:

| | % |
|---|---|
| Cu | 57.6 |
| Fe | 7.0 |
| S(Sulfide) | 27.5 |
| U | 25 (PPM) |

The solids density in the PROX feed was 19% and the leach temperature was 185° C. with an oxygen partial pressure of 700 kPa.

The leachate composition after 15 minutes into the leach was:

| | g/L |
|---|---|
| Cu | 110 |
| Fe | 0.35 |
| $H_2SO_4$ | ~1.0 |
| pH | 3.0 |
| Eh | +437 (Ag/AgCl @ 3.8M KCl) |

and the residue at 15 minutes assayed:

| | % |
|---|---|
| Cu | 26.3 |
| Fe | 19.7 |
| S(Sulfide) | 5.0 |
| S(Sulfate) | 4.2 |
| U | 10 (PPM) |

The present invention has this PROX slurry at 185° C. containing 110 g/L Cu as cupric sulfate directly coupled to the NONOX reactor where the dirty copper concentrate described in Example 1 was also charged.

The upgraded concentrate after 60 minutes into the NONOX leach assayed:

| | % |
|---|---|
| Cu | 51.8 |
| Fe | 13.3 |
| S(Sulfide) | 27.6 |
| U | 34 (PPM) |

The removal of uranium in the NONOX leach was in excess of 97% and the copper upgrade was 80%. After a further 60 minutes (total 120 minutes) into the NONOX leach the copper in the upgraded concentrate was:

| | % |
|---|---|
| Cu | 60.3 |
| Fe | 7.7 |
| S(Sulfide) | 24.9 |
| U | 30 (PPM) |

This copper assay corresponds to a copper upgrade in excess of 100%.

Example 3

A radioactive copper concentrate with the following composition was subjected to a NONOX leach:

| | % |
|---|---|
| Cu | 30-33 |
| Fe | 27-29 |
| S | 30 |
| $Pb^{210}$ | 6-7 Bq/g |
| $Po^{210}$ | 6-7 Bq/g |

The NONOX residue assay was:

| | % |
|---|---|
| Cu | 62-63 |
| Fe | 4-9 |
| S | 24-28 |
| $Pb^{210}$ | 1.4 Bq/g |
| $Po^{210}$ | 1.2 Bq/g |

The NONOX residue was subjected to an aerobic alkali leach at 95 to 100° C. employing 40 kg of sodium hydroxide per tonne of feed upgraded concentrate. This was followed by an hydrochloric acid leach at 95 to 100° C. employing approximately 40 kg of hydrochloric acid per tonne of feed upgraded concentrate. The radionuclide content of the final concentrate was:

| | Bq/g |
|---|---|
| $U^{238}$ | 0.12 |
| $Th^{230}$ | 0.56 |
| $Ra^{226}$ | 0.73 |
| $Pb^{210}$ | 0.35 |
| $Po^{210}$ | 0.62 |

The base metal and sulfur content of this upgraded concentrate was approximately that of the NONOX residue.

Now that preferred embodiments of the hydrometallurgical method for the removal of radionuclides from a radioactive copper concentrate have been described in detail, it will be apparent that the described embodiments provide a number of advantages over the prior art, including the following:

(i) Reduced level of radioactive emission in the resulting copper concentrate after treatment in the NONOX reactor of the invention.

(ii) Reduced level of radioactive emission allows the copper concentrate to be suitable for smelting.

(iii) Reduced level of radioactive emission allows the copper concentrate to be suitable for transport and meeting legislative standards.

It will be readily apparent to persons skilled in the relevant arts that various modifications and improvements may be made to the foregoing embodiments, in addition to those already described, without departing from the basic inventive concepts of the present invention. Therefore, it will be appreciated that the scope of the invention is not limited to the specific embodiments described and is to be determined from the appended claims.

The invention claimed is:

1. A hydrometallurgical method for the removal of one or more radionuclides from a radioactive copper concentrate to produce an upgraded copper concentrate having lowered emission levels, the method comprising:

subjecting the copper concentrate to an acidic leaching with a sulfate and chloride containing lixiviant under electrochemically controlled conditions, to at least partially remove one or more of the radionuclides to produce the lowered emission upgraded copper concentrate, wherein the acidic leaching is conducted at elevated temperature and under pressure to suppress boiling in the acidic leaching.

2. A hydrometallurgical method as defined in claim 1, wherein the acidic leaching is conducted at an electrochemical potential of greater than 200 mV (Ag/AgCl 3.8M KCl).

3. A hydrometallurgical method as defined in claim 2, wherein the acidic leaching is conducted at an electrochemical potential in the range of between about 200 mV and 450 mV (Ag/AgCl 3.8M KCl).

4. A hydrometallurgical method as defined in claim 1, wherein the electrochemical potential of the acidic leaching is controlled by the presence of, or the addition to the acidic leaching of, one or more of copper sulfate, ferric ion, air, oxygen, sodium chlorate, pyrolusite, or hematite.

5. A hydrometallurgical method as defined in claim 1, wherein the sulfate and chloride containing lixiviant comprises copper sulfate and sodium chloride.

6. A hydrometallurgical method as defined in claim 1, wherein the one or more radionuclides comprise one or more radionuclides selected from the group consisting of U238, Th230, Ra226, Pb210, Po210 and Bi210.

7. A hydrometallurgical method as defined in claim 1, wherein the one or more radionuclides comprise uranium, thorium, radium, lead, bismuth and polonium; and wherein the acidic leaching removes about 50% to 99% of the uranium and thorium, and lowers radium, lead, bismuth and polonium levels to below 3 Bq/g.

8. A hydrometallurgical method as defined in claim 1, wherein the sulfate and chloride containing lixiviant comprises one or more of the following solutes: sulfuric acid, hydrochloric acid, sodium chloride, chloride salt, potassium chloride, and copper sulfate, the sulfate and chloride containing lixiviant being obtained from a source external to the acidic leaching.

9. A hydrometallurgical method as defined in claim 1, wherein the sulfate and chloride containing lixiviant comprises one or more of seawater, brines from seawater desalination, and fluorides, or anions leached from the radioactive copper concentrate, or from process water.

10. A hydrometallurgical method as defined in claim 1, wherein the acidic leaching is conducted between about 100 degrees C. and 240 degrees C.

11. A hydrometallurgical method as defined in claim 10, wherein the acidic leaching is conducted between about 160 degrees C. and 240 degrees C.

12. A hydrometallurgical method as defined in claim 1, wherein copper-iron-sulfides and cupric sulfide are transformed in the acidic leaching, and wherein the acidic leaching is conducted under conditions to transform 50% to 99% of the copper-iron-sulfides to iron-depleted copper sulfides and cupric sulphide to a sulfur-depleted product.

13. A hydrometallurgical method as defined in claim 1, wherein each radionuclide in the lowered emission upgraded copper concentrate has a radioactive emission level of about 0.1 to 1.5 Bq/g.

14. A hydrometallurgical method as defined in claim 1, wherein the one or more radionuclides comprise U238, Th230, Ra226, Pb210, Bi210, Po210; and wherein the lowered emission upgraded copper concentrate has a radioactive emission level of less than about 0.5 Bq/g for each of U238 and Th230, and a radioactive emission level of less than about 3 Bq/g for each of Ra226, Pb210, Bi210, Po210.

15. A hydrometallurgical method as defined in claim 1, wherein the acidic leaching is conducted at a pressure in the range of 500-3500 kPa.

16. A hydrometallurgical method as defined in claim 1, wherein retention time of the acidic leaching is between about 0.5 and 8 hours.

17. A hydrometallurgical method as defined in claim 1, further comprising feeding into the acidic leaching a copper sulfate slurry from a pressure oxidation reactor, or copper sulfate solution from an external source.

18. A hydrometallurgical method as defined in claim 17, wherein the sulfate slurry comprises copper sulfate, iron sulfate and sulfuric acid.

19. A hydrometallurgical method as defined in claim 1, wherein the method further comprises an alkali and/or an acid pre-treatment step to reduce the radionuclide activity of the radioactive copper concentrate prior to the acidic leaching.

20. A hydrometallurgical method as defined in claim 19, wherein the pre-treatment step comprises repulping of the copper concentrate with copper-rich process liquors to form a repulped concentrate, treating the repulped concentrate with steam to raise the temperature, and removing copper from the repulped concentrate in a metathesis process.

21. A hydrometallurgical method as defined in claim 1, wherein the method further comprises a post-treatment step to further remove one or more radionuclides from the lowered emission upgraded copper concentrate.

22. A hydrometallurgical method as defined in claim 21, wherein the post-treatment step comprises cooling of the lowered emission upgraded copper concentrate to produce a cooled slurry, thickening of the cooled slurry, and filtering of the thickened cooled slurry to produce a further upgraded copper concentrate.

23. A hydrometallurgical method as defined in claim 21, wherein the one or more radionuclides comprise Ra226, Pb210, Po210 and Bi210, and wherein the post-treatment step comprises an acid treatment to remove the radionuclides of Ra226, Pb210, Po210 and Bi210.

* * * * *